United States Patent [19]

Swanson

[11] 4,314,701

[45] Feb. 9, 1982

[54] PUTTER CLUB

[76] Inventor: Arthur P. Swanson, 1454 Estate La., Glenview, Ill. 60025

[21] Appl. No.: 213,367

[22] Filed: Dec. 5, 1980

[51] Int. Cl.[3] ..... A63B 53/04

[52] U.S. Cl. ..... 273/164; 273/167 J

[58] Field of Search ..... 273/77 R, 163 R, 164, 273/167–174, 183 D; D21/217–219

[56] References Cited

U.S. PATENT DOCUMENTS

| | | | |
|---|---|---|---|
| D. 217,487 | 5/1970 | Blake | 273/164 X |
| D. 217,567 | 5/1970 | Williams | D21/218 |
| D. 230,615 | 3/1974 | Delgadillo | 21/215 |
| D. 233,616 | 11/1974 | Verzillo | 273/164 X |
| D. 235,893 | 7/1975 | Becker | 273/164 X |
| D. 241,563 | 9/1976 | McCord | 273/164 X |
| D. 252,221 | 6/1979 | Mariani | D21/217 |
| 1,319,802 | 6/1919 | Shea | 273/167 G |
| 1,537,320 | 5/1925 | Marsh | 273/167 G |
| 1,652,404 | 12/1927 | Graveure | 273/164 |
| 1,703,199 | 2/1929 | McClure | 273/164 X |
| 2,820,638 | 1/1958 | Morrison | 273/164 |
| 3,037,770 | 6/1962 | Palmer | 273/80 C |
| 3,218,072 | 11/1965 | Burr | 273/164 X |
| 3,387,845 | 6/1968 | Raub | 273/164 X |
| 3,408,074 | 10/1968 | Antonious | 273/164 |
| 3,578,332 | 5/1971 | Caldwell | 273/164 |
| 3,912,274 | 10/1975 | Brace | 273/164 |
| 4,138,117 | 2/1979 | Dalton | 273/164 |

OTHER PUBLICATIONS

Advertisement of "Ray Cook" putter now on the market.

*Primary Examiner*—Richard J. Apley

*Attorney, Agent, or Firm*—Hill, Van Santen, Steadman, Chiara & Simpson

[57] ABSTRACT

A golf ball putter club has a generally rectangular blade head with a front putting face, a substantially flat rocker bottom, an upright back wall, and a central cylindrical portion having a diameter matching the diameter of a golf ball to be putted with narrow heel and toe portions projecting laterally from this central cylindrical portion. The top half of this cylindrical portion extends above the heel and toe portion and matches the top half of the golf ball to be easily aligned behind the ball and present a "sweet spot" on the putting face at the axis of the cylindrical portion. A shaft extends upwardly from the central cylindrical portion of the blade with its axis intersecting the longitudinal axis of the cylindrical portion for transmitting putting energy in alignment with the sweet spot. The equatorial plane of the central cylindrical portion is level with the tops of the heel and toe portions and longitudinal grooves are cut into the ends of this plane to better define and sharpen for ease in sighting, the semi-cylindrical portion which extends above the narrow heel and toe portions. These grooves also provide sighting lines for straddling of the ball to facilitate alignment.

The central cylindrical portion may have a depth greater than the narrow end portions and the shaft or hosel of the shaft preferably enters the cylindrical portion closely adjacent the extension so that a substantial portion of the top face of the cylindrical portion will be forwardly of the shaft. The shaft preferably slopes at about an angle of 70° from the longitudinal axis of the blade.

9 Claims, 6 Drawing Figures

PUTTER CLUB

BACKGROUND OF THE INVENTION

1. Field of the Invention

This invention relates to golf ball putters and particularly deals with blade type putters with cylindrical central portions having the same diameter of the golf ball and projecting above the tops of the end portions of the blade to be aligned immediately behind the golf ball and provide a ball impacting sweet spot on the axis thereof.

2. Description of the Prior Art

Blade type putters have relatively narrow putting faces which are frequently positioned too high or too low for properly propelling the ball. For example, when the narrow band putting face impacts the ball beneath its horizontal diameter, the ball will bounce and deflect from the putting line whereas a raising of the narrow band putting face to impact the ball above the horizontal diameter thereof will drive the ball into the putting surface and spoil the momentum of the putt. It would then be an improvement in the art to provide a blade-type putter with a central putting face having the same diameter as the golf ball and presenting a semi-cylindrical top surface that is easily aligned directly behind the visible top half of the ball to position a "sweet spot" zone on the axis of the cylindrical portion that will impact the ball on a horizontal plane through the center of the ball thereby imparting a smooth propelling of the ball on the line of putt. A further improvement in the art would be to position the shaft of the putter so that its axis intersects the axis of the cylindrical portion close to the "sweet spot" of the putting face.

SUMMARY OF THE INVENTION

According to this invention errors in aligning a putter with the ball are minimized by a blade head having a central cylindrical area of golf ball diameter size with its top half projecting above narrow lateral heel and toe portions to present a visible top circumferential surface which is easily aligned in horizontal and vertical planes immediately behind the golf ball to be impacted and presenting a front putting face with a "sweet spot" impact zone on the axis of the cylindrical portion. To sharply define the ends of the horizontal equatorial plane of the cylindrical portion, longitudinal grooves are cut into the top face of the blade at these ends thereby providing guidelines for straddling the ball. The blade has a generally flat sole intersecting the bottom of the cylindrical portion so that when the sole is lifted to provide putting clearance with the putting surface the "sweet spot" will be level with the horizontal plane through the center of the ball. However, even though the blade is raised too high off of the putting surface, the sweet spot zone has sufficient size to propel the ball on a true putting line and even impart a top spin to the ball.

The overall length of the blade may be about four inches, and the thickness or depth about $\frac{3}{4}$ inch. The diameter of the central cylindrical portion conforms with the diameter of the golf ball which is 1.68 inches in the United States and somewhat smaller in England but about $\frac{1}{8}$ inch of the bottom of the cylindrical portion is cut flat so that when the blade is raised about $\frac{1}{8}$ of an inch off of the putting surface, the axis of the cylindrical portion will be aligned with the horizontal plane through the center of the ball resting on the surface. The heel and toe ends of the blade are about $\frac{3}{4}$ inch high and about 1.16 inches long. The grooves straddling the central cylindrical portion are about $\frac{1}{8}$ inch wide and deep and lie below the axis of the cylindrical portion. Therefore the top half of the cylindrical portion is completely visible to the golfer.

The back of the cylindrical portion extends beyond the back of the heel and toe portions about 3/16 to $\frac{1}{4}$ of an inch and the shaft extends into the top of the cylindrical portion adjacent this rear extension so that the major portion of the top of the cylindrical portion and the grooves are visible to the golfer. The front putting face has a loft of about 3° to 6° and the shaft extends at an angle of about 70° from the horizontal axis of the blade.

It is then an object of this invention to provide a blade type golf ball putter with an enlarged cylindrical central portion of golf ball diameter size with a top half visible to the golfer and straddled by alignment grooves normal to the putting face so that when the blade is positioned to align the cylindrical portion directly behind the golf ball, the ball will be impacted by a sweet spot zone on the axis of the cylindrical portion.

Another object of the invention is to provide a blade type putter with a raised central semi-cylindrical portion of golf ball diameter size visible to the golfer on the top of the blade.

Another object of the invention is to provide a golf ball putter club with a blade type head having narrow ends and a central portion extending above said ends and presenting to the golfer's line of sight a semi-cylindrical top of the same radius as the golf ball for alignment in horizontal and vertical planes behind the golf ball and having a central axis providing a "sweet spot" to impact the ball at its horizontal diametric plane.

Another object of the invention is to provide a blade type putter with narrow ends having a cylindrical central portion with a flat bottom flush with the bottoms of the ends, a front putting face, and an exposed semi-cylindrical upper portion straddled by grooves at the equator thereof.

Other and further objects of this invention will be apparent to those skilled in this art from the following detailed description of the annexed sheet of drawings which, by way of an example only, illustrate one embodiment of the invention.

ON THE DRAWINGS

AS SHOWN ON THE DRAWINGS

Figure 1:
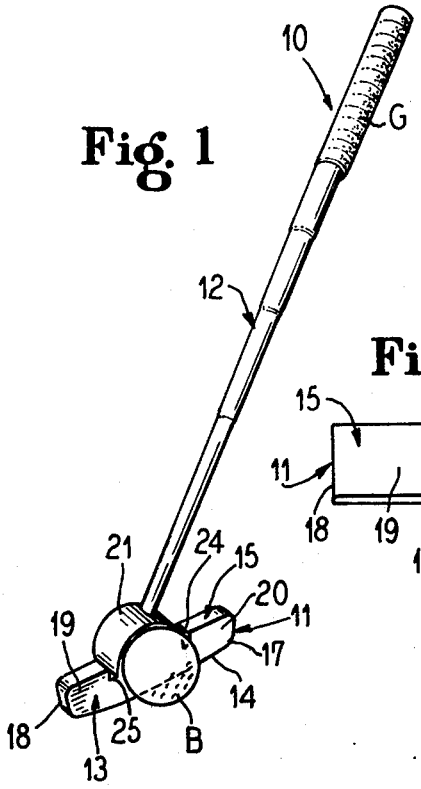
FIG. 1 is a front perspective view of a blade putter of this invention aligned for a putt behind a golf ball.
Figure 3:
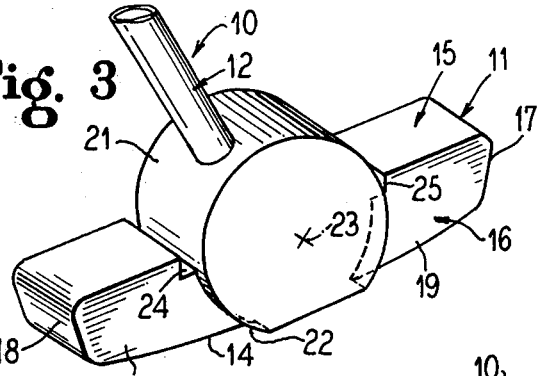
FIG. 3 is a rear perspective view of the blade and lower end of the shaft of the putter of FIGS. 1 and 2.

The ball putter of FIGS. 1 to 6 has a blade head 11 and a shaft 12 projecting from the top of the head. The blade head 11 is a relatively thin rectangular strip formed of metal such as steel or brass. Brass is a preferred material for the head because it is softer than steel and has some resilience. The shaft 12 is a metal tube, preferably chrome plated steel, tapering through stepped sections from a small diameter lower end entering the top of the blade 11 to a large diameter end covered with leather, plastics material or the like forming a grip G for the hands of the golfer. The blade head 11 can be molded, forged, cast, or machined from a rectangular strip.

The blade head 11 has an upright slightly lofted planar front putting face 13 for impacting a golf ball B. An incline of about 3° to 6° from the vertical is desirable for a lofted putting face. The head 11 also has a bottom sole 14 which is flat across its width or depth and may have a flat arc shape along its length with a generally flat midsection. The blade head 11 also had a top 15 which is flat across its width or depth extending from the putting face 13 to an upstanding vertical back 16. An upright slightly curved end wall 17 forms the toe end of the head while a similar shaped end wall 18 forms the heel end of the head.

The head has relatively narrow toe and heel ends 19 and 20 extending inwardly from the ends 17 and 18 to a cylindrical mid portion 21 with the top half thereof extending above the narrow ends and presenting to the sight line of the golfer a semi-cylinder to be aligned in horizontal and vertical planes immediately behind the golf ball B when addressing the ball for a putt. This central cylindrical portion 21 has a thickness or depth somewhat greater than the narrow heel and toe portions 19 and 20 which projects beyond the back face as a cylindrical disk 22 for a distance of about 3/16 inch.

The bottom of the cylindrical central section 21 and its extending disk portion 22 is cut flat by the sole 14 so that when the head 11 is lifted off of the putting surface a distance of about $\frac{1}{8}$ inch, the axis 23 of the cylindrical portion 21 will be level with the horizontal equatorial plane through the center of the golf ball B.

The central cylindrical portion 21 has a radius R struck from this central axis 23 of a length the same as the radius of the golf ball B so that the diameter of the central portion 21 is 1.68 inches which is the same as the diameter of the standard United States approved golf ball.

Longitudinal grooves 24 and 25 about $\frac{1}{8}$ inch wide and deep are cut in the top face 15 of the putter head 11 normal to the putting face 13 and having a depth providing flat bottom walls below the horizontal diameter D of the cylindrical mid portion 21. These grooves 24 and 25 sharpen the delineation of the ends of the equatorial plane through the cylindrical portion 21 to straddle the golf ball B on sight lines during the alignment of the putter for the putting stroke. Thus the golfer sights the semicylindrical central section 21 relative to the ball so that it is positioned immediately behind the ball and aligned with the ball in both horizontal and vertical planes with the putting face 13 normal to the intended line of putt and with the grooves 24 and 25 straddling the ball.

The shaft 12 preferably enters the top of the cylindrical portion 21 at an angle of about 70° from the horizontal axis of the blade head 11 and has its center line intersecting the axis 23 of the cylindrical portion a substantial distance rearwardly from the putting face 13. Thus, as shown, the shaft enters the cylindrical portion 21 in approximate alignment with the rear faces of the narrow portions 19 and 20 of the putter head giving a clear view of the top circumference of the portion 21 forwardly of the shaft. The golfer can then easily view the exposed circumference of this portion 21 and align it, both vertically and horizontally, with the ball. Parallel or peripheral vision sighting over the top semicylindrical circumference of the portion 21 aligns the ball and putter even though the eyes of the golfer are not directly over the ball. The grooves 24 and 25 are also easily aligned to straddle the ball and provide a further guide to sharpen the alignment.

Figure 2:
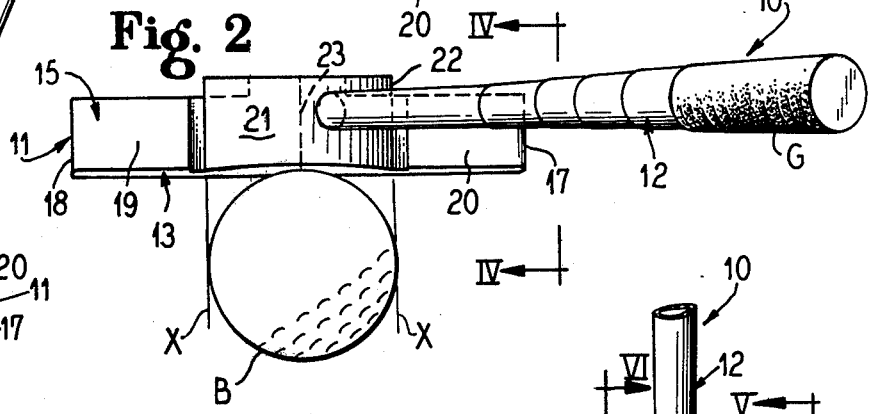
FIG. 2 is a plan view of the putter from the top of FIG. 1.

As shown in FIG. 2, the thin lines X—X projected forwardly from the exposed sides of the circumference of the top of the cylindrical portion 21 straddle the ball thereby properly aligning the putter head laterally or horizontally with the ball B.

Figure 4:
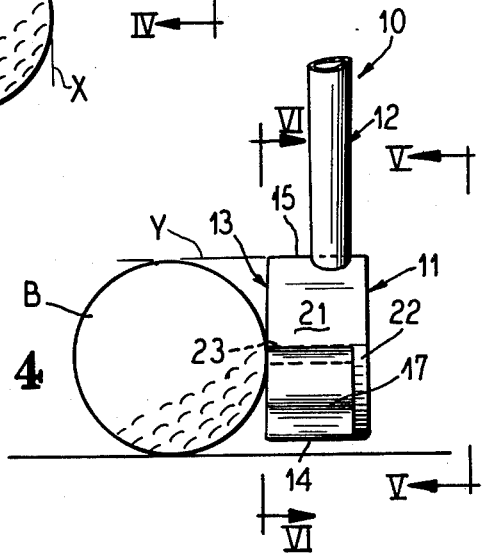
FIG. 4 is a heel end view of the blade head and lower end of the shaft taken along the line IV—IV of FIG. 2.
Figure 6:
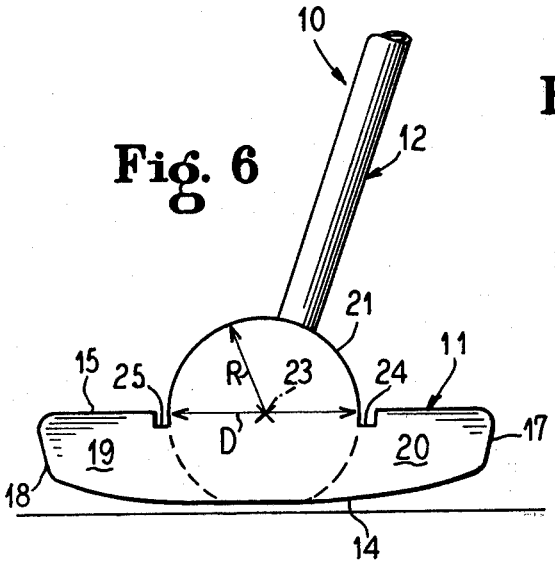
FIG. 6 is a front view taken along the line VI—VI of FIG. 4.
Figure 5:
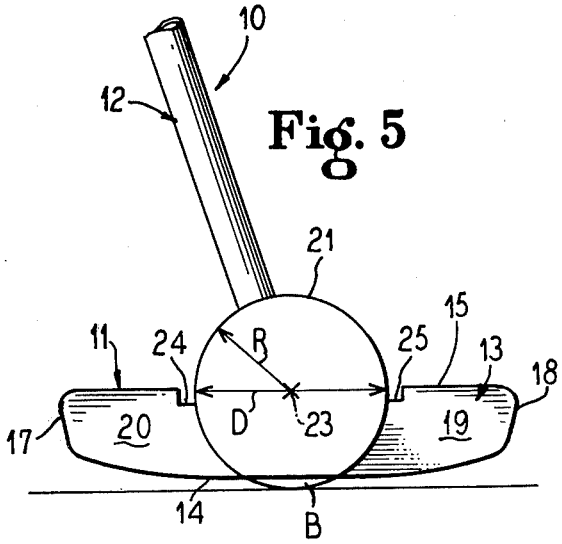
FIG. 5 is a back view taken along the line V—V of FIG. 4.

As shown in FIG. 4, when the putter head is raised about $\frac{1}{8}$ inch above the putting surface, the exposed apex of the cylindrical portion 21, as illustrated by the dotted line Y is in direct alignment with the apex or top of the ball B, thus aligning the putter head in an upright or vertical plane.

It will therefore be understood that the raised semicylindrical top of the putter head, when aligned behind the ball B as illustrated in FIGS. 2 and 4 will position the horizontal axis 23 of the cylindrical portion 21 directly behind the center of the ball B so that the "sweet spot" on the putting face will impact the ball to propel it on the exact putting line sighted by the golfer.

The positioning of the axis of the shaft 12 to intersect the axis 23 of the cylindrical portion 21 facilitates the alignment of the cylindrical portion behind the ball and minimizes putting errors due to inadvertent rotation of the shaft during the putting stroke. While the shaft is shown as having a single center line or axis extending into the top of the putter head 11 it should be understood that different shaft configurations may be provided including shafts with bent or angled lower ends secured to the putter head. It will also be understood that the head may have a hosel receiving the lower end of the shaft.

While the above described and illustrated putter is for a right-handed golfer, the principles of this invention are also applied to putters for left-handed golfers and are made available for such use by merely reversing the shaft position so that the toe of the blade for a right-handed golfer becomes the heel of the blade for the left-handed golfer.

From the above descriptions it will thus be understood that this invention provides a blade putter with narrow toe and heel end portions and a central semi-circular extension above the tops of the toe and heel portions to present a fragmental disc like configuration on the top of the blade which has a diameter the same as the diameter of the golf ball and which is easily aligned in both vertical and horizontal planes to be positioned immediately behind the golf ball so that the putting face will impact the ball on the axis of the cylindrical portion and at the rear end of the horizontal diametric plane through the ball. At the same time, however, the zone of the "sweet spot" on the putting face is large enough to accomodate raising of the sole 14 of the blade more than usual off of the putting surface to impart top spin to the ball and since the shaft axis is close to the center of the "sweet spot" zone, inadvertant rotation or rocking of the shaft unless excessive, during the putting stroke will not spoil the putt.

I claim as my invention:

1. A golf putter comprising a generally rectangular blade head with a flat planar front putting face, a bottom sole, heel and toe end portions with top faces, a raised central enlarged height fragmental cylindrical mid-section above said top faces and coplanar with said front putting face, said mid-section having an exposed greater than semi-cylindrical top cylindrical periphery visible to the full diameter thereof, said mid-section having an axis normal to said putting face at a level adjacent the top faces and above the bottom of the exposed periphery, said mid-section having a radius the same as the golf ball to be putted, a substantially flat bottom on said sole intersecting an imaginary continuation of said cylindrical portion, and a shaft having a bottom end projecting upwardly from said mid-section with an axis intersecting said axis of said mid-section whereby alignment of the exposed top periphery vertically and horizontally behind the golf ball positions the sole off of the putting surface, accommodates variations in the positions of the golfer's eyes and causes the putting face to impact the ball on said axis of said mid-section.

2. The golf putter of claim 1 wherein said shaft is positioned rearwardly from said putting face sufficiently to expose the full diameter of said cylindrical portion.

3. The golf putter of claim 1 including a cylindrical disc extension on said back of the blade head coaxial with and having the same radius as said cylindrical portion.

4. The golf putter of claim 1 including spaced parallel transverse grooves in the top faces of the heel and toe end portions at the ends of the diameter of the raised mid-section increasing the exposed periphery of said mid-section below said top faces.

5. The golf putter of claim 1 wherein said radius is 0.84 inches.

6. The golf putter of claim 1 wherein said heel and toe end portions have rear surfaces constituting the back of said head and said top cylindrical periphery of said mid-section extends rearwardly beyond said back of said head.

7. A golf putter head which comprises a generally rectangular blade having a flat planar front putting face with a raised semi-cylindrical central portion having an axis normal to said putting face and substantially flush with the top of the blade together with a radius the same as the golf ball to be putted and an exposed full diameter periphery adapted to be aligned behind the golf ball, said putting face having a height below said axis only slightly less than said radius, and transverse parallel grooves in the top of the blade at the ends of the diameter of said central portion increasing the extent of said exposed periphery whereby said periphery will be visible to the eyes of the golfer to align the central portion behind the ball with the blade lifted off of the putting surface for striking the ball on said axis even when the eyes of the golfer are not directly over the ball.

8. The golf putter head of claim 7 wherein said grooves straddle the golf ball to facilitate alignment of the central portion behind the ball.

9. The golf putter head of claim 7 wherein said grooves are about one-eighth inch deep.

* * * * *